United States Patent [19]

Stites

[11] Patent Number: 4,529,192

[45] Date of Patent: Jul. 16, 1985

[54] SWIMMER EXERCISING APPARATUS

[76] Inventor: Alfred W. Stites, Energy Concepts Company, 1340-B Rufina Cir., Santa Fe, N. Mex. 87501

[21] Appl. No.: 496,922

[22] Filed: May 23, 1983

[51] Int. Cl.[3] ..... A63B 69/14

[52] U.S. Cl. ..... 272/71; 434/254

[58] Field of Search ..... 272/71, 117, 1 B, 70, 272/73, 93, 125, 136, 139, 94, 132; 434/254; 441/55-56

[56] References Cited

U.S. PATENT DOCUMENTS

| | | | |
|---|---|---|---|
| 2,434,543 | 1/1948 | Borroughs | 272/71 |
| 2,970,636 | 2/1961 | Haugland | 272/93 |
| 3,140,550 | 7/1964 | Wayfield . | |
| 3,218,070 | 11/1965 | Crowther | 272/136 |
| 3,224,765 | 12/1965 | Baker et al. | 272/132 |
| 3,373,991 | 3/1968 | Smalley | 272/71 |
| 4,109,905 | 8/1978 | Meier . | |
| 4,114,874 | 9/1978 | Mattila . | |
| 4,218,056 | 8/1980 | Whitling . | |
| 4,247,096 | 1/1981 | Schmitt | 272/71 |

FOREIGN PATENT DOCUMENTS

| | | | |
|---|---|---|---|
| 340724 | 10/1959 | Switzerland | 441/55 |

OTHER PUBLICATIONS

Hydra-Gym Athletics, Inc. from "Coach and Athlete", Dec. 1976.

*Primary Examiner*—Richard J. Apley
*Assistant Examiner*—S. R. Crow
*Attorney, Agent, or Firm*—Yost Felter Barberousse Yost & Silver

[57] ABSTRACT

Apparatus to be used in a swimming pool for improving a swimmer's proficiency and endurance. The apparatus consists of shoulder pads which engage the shoulders of the swimmer and are attached to two arms which extend to a housing which contains tension providing structure. The housing has two support arms extending therefrom to pads frictionally engaged with the side wall of a pool.

1 Claim, 6 Drawing Figures

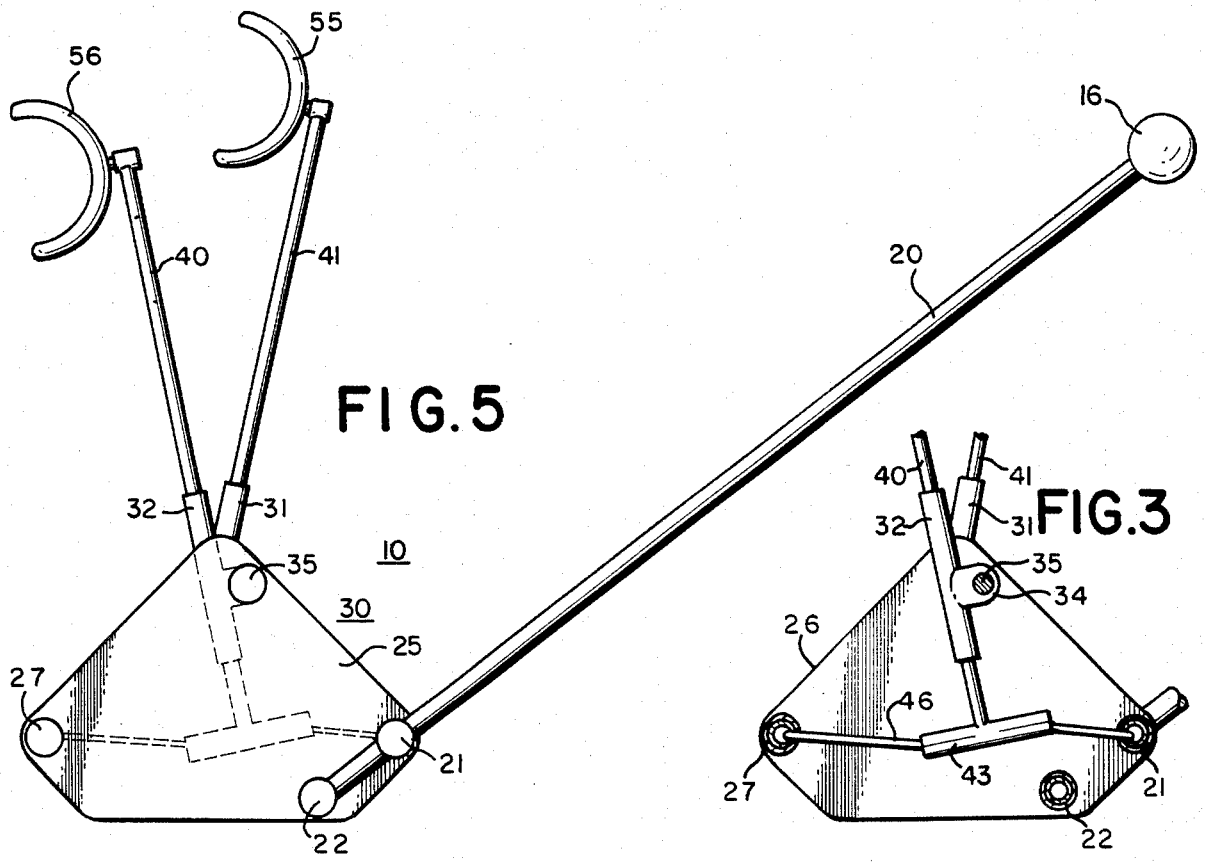
FIG. 5
FIG. 3
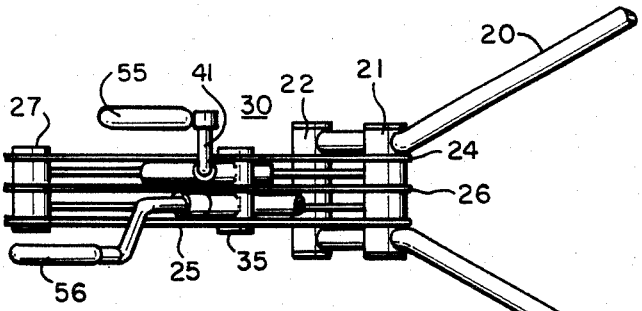
FIG. 6
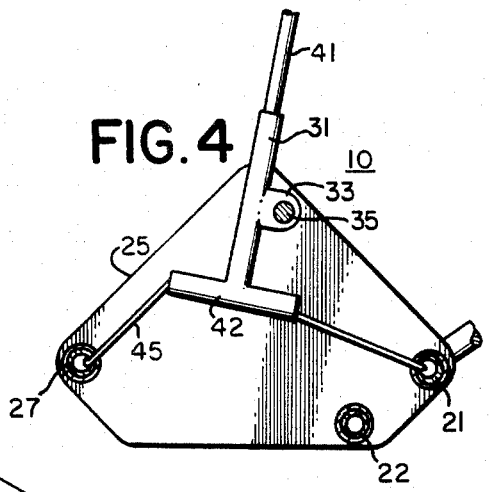
FIG. 4
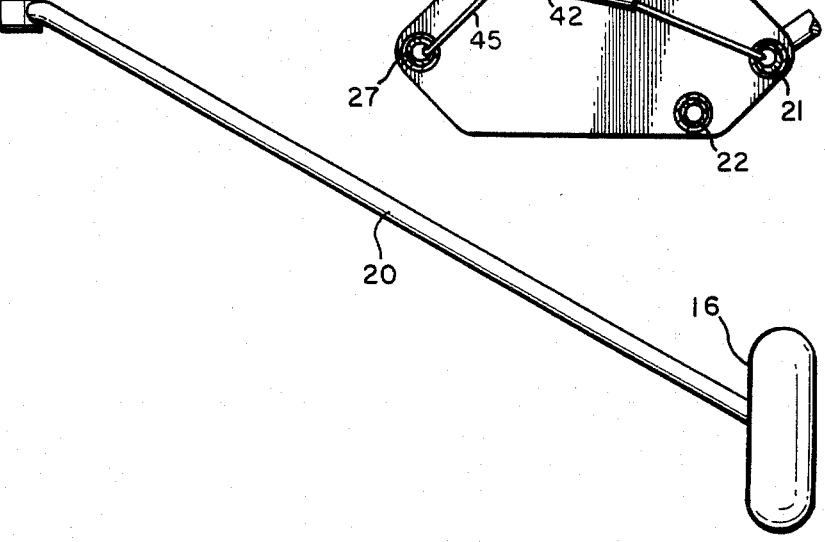

SWIMMER EXERCISING APPARATUS

BACKGROUND OF THE INVENTION

1. Field of the Invention

This invention relates to swimmer exercising apparatus of the type which is self-contained, portable, engages a wall of a pool and has portions that engage the shoulders of a swimmer, to simulate resistance, so as to enable the swimmer to improve his proficiency and build up his endurance.

2. Description of the Prior Art

There has long been a need for an apparatus that allows a swimmer to swim continually in smaller pools where lap-swimming is not possible, or in a pool which is too short to allow more than a few strokes before requiring the swimmer to turn. There is also a need for an apparatus that would allow a less than proficient swimmer to exercise, while at the same time improving his form and building endurance.

There have been many devices proposed to assist swimmers in improving form and increasing endurance. One such device is shown in the U.S. Patent to WAYFIELD, U.S. Pat. No. 3,140,550, which includes a large non-buoyant cabinet, with head rest means to be contacted by the head of a swimmer, and when contacted, turns on jets of water and a series of lamps to simulate the swimmer's desired positions, and speed on a translucent screen. This structure is quite complicated, does not provide restraint at the best locations, and suffers from other shortcomings, The U.S. Patent to MEIER, U.S. Pat. No. 4,109,905, illustrates a device that includes a foam rubber belt to be placed around the waist of a swimmer, which has a flexible cord attached thereto, and secured to the side of a pool. This structure does not provide restraint at the best locations and requires attachment to the swimmer's body.

The U.S. Patent to MATTILA, U.S. Pat. No. 4,114,874, illustrates an appliance which includes a housing to be attached to a pool ladder, with a spool therein, a rope or tension member engaged with the spool and a harness that engages a swimmer's waist. The housing contains a brake disc and mechanism to apply frictional force on the spool, to provide the desired resistance force to the swimmer's movement through the water. This appliance is complicated, must be fastened to the pool ladder, must be attached to a swimmer's waist, and does not provide resistance at the best locations on a swimmer.

The U.S. Patent to WHITLING, U.S. Pat. No. 4,218,056, illustrates an aquatic training aid that includes a socket to receive a swimmer's head, coupling means to connect to the pool wall, and a pair of handles to be grasped by the swimmer. This device is complicated, does not provide unrestricted swimming movement by the swimmer, and does not provide resistance at the best locations on a swimmer's body.

The apparatus of my invention is portable, does not require attachment to a portion of the pool or to a swimmer's body, provides exercise and also unrestricted swimming movement of a swimmer's body while encouraging form improvement.

SUMMARY OF THE INVENTION

Swimmer exercising apparatus is provided which engages a swimmer's shoulders, provides resistance to swimming movements, and is detachably engaged with a wall of a swimming pool.

The principal object of the invention is to provide a swimmer exercising apparatus that enables a swimmer to improve his proficiency and build up his endurance.

A further object of the invention is to provide apparatus of the character aforesaid that is portable and self-contained.

A further object of the invention is to provide apparatus of the character aforesaid that can be used by swimmers of varying size and that provides resistance at the swimmer's shoulders.

A further object of the invention is to provide apparatus of the character aforesaid that is simple and inexpensive to construct, but durable and long lasting in use.

Other objects and advantageous features of the invention will be apparent from the description and claims.

DESCRIPTION OF THE DRAWINGS

The nature and characteristic features of the invention will be more readily understood from the following description taken in conjunction with the accompanying drawings forming part hereof, in which:

FIG. 3 is a vertical sectional view taken approximately on the Line 3—3 of FIG. 2;

FIG. 4 is a vertical sectional view taken approximately on the Line 4—4 of FIG. 3;

FIG. 5 is a side elevational view of the apparatus of FIG. 1; and

FIG. 6 is a top fragmentary view, enlarged, of the apparatus of FIG. 1.

It should, of course, be understood that the description and drawings herein are illustrative merely, and that various modifications and changes can be made in the structure disclosed without departing from the spirit of the invention.

Like numerals refer to like parts throughout the several views.

DESCRIPTION OF THE PREFERRED EMBODIMENT

Figure 1:
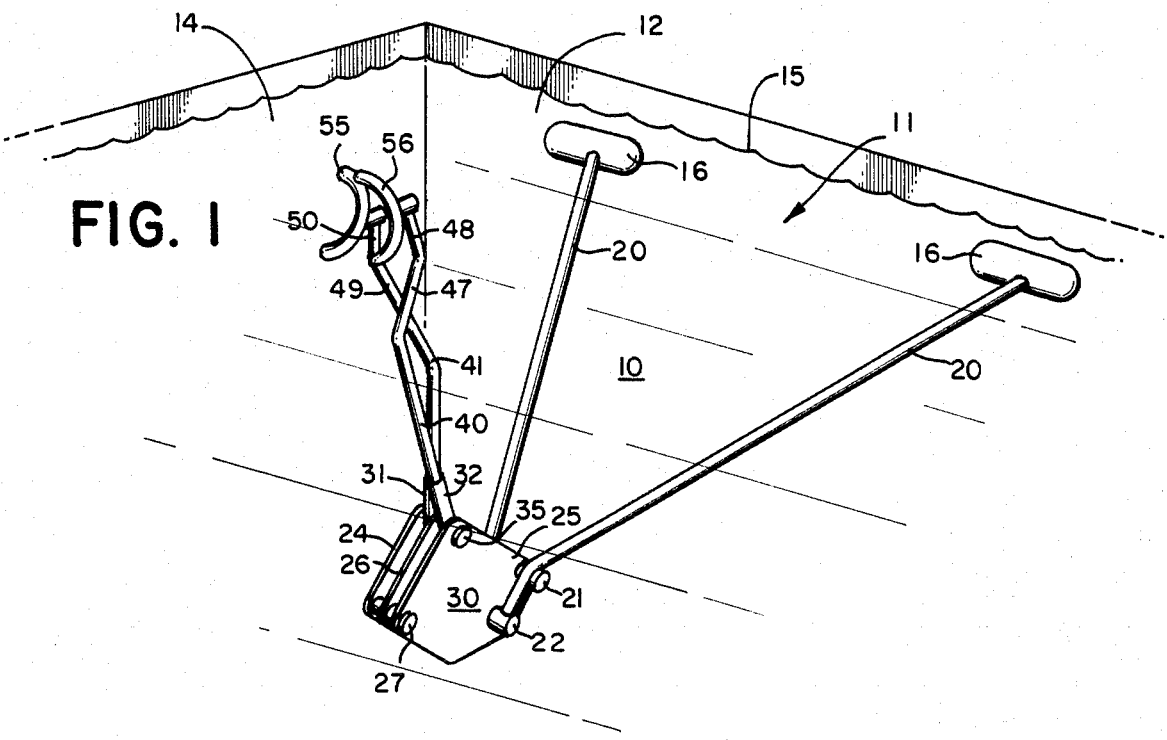
FIG. 1 is a view in perspective illustrating the apparatus of the invention in place in a swimming pool.
Figure 2:
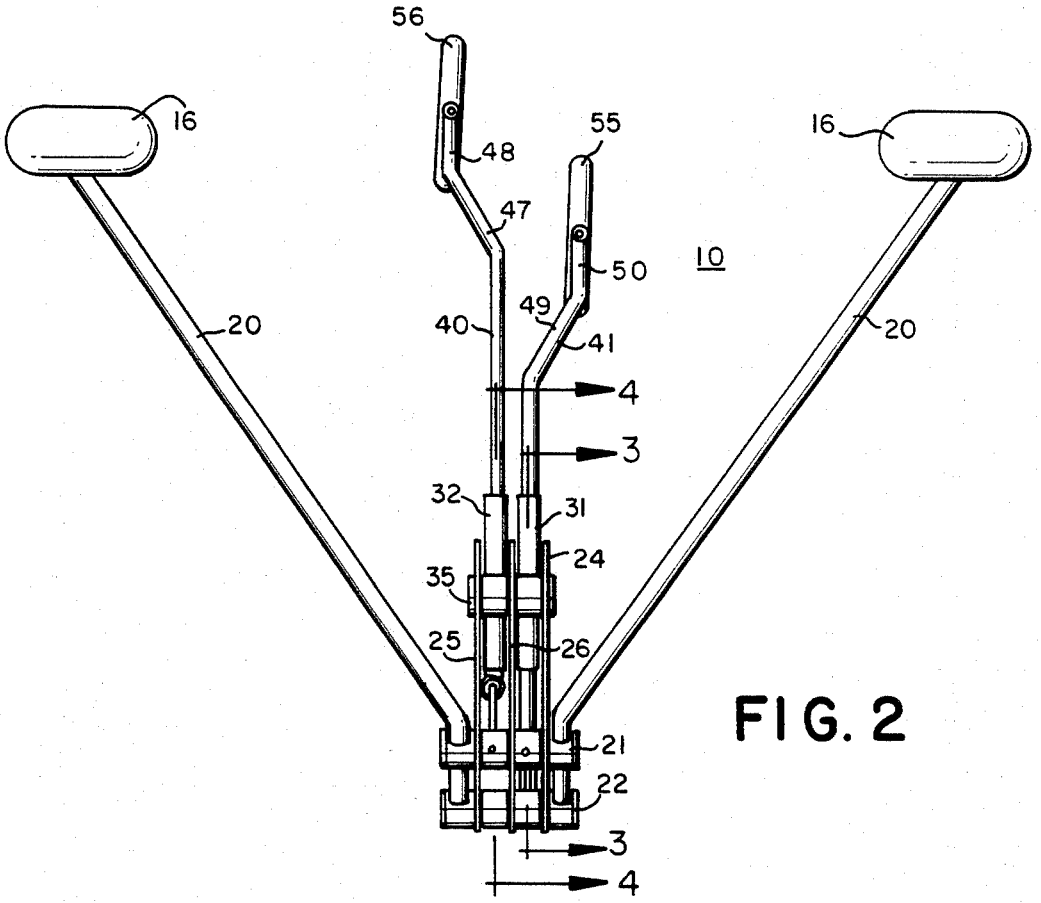
FIG. 2 is a front elevational view, enlarged, of the apparatus of FIG. 1.

Referring now more particularly to the drawings and FIGS. 1 to 6 inclusive, in FIG. 1, the swimmer exercising apparatus 10 is shown in place in a pool 11, having intersecting side walls 12 and 14 with a water level as shown at 15. The apparatus 10 includes a pair of pads 16 of cylindrical configuration, which can be formed of molded synthetic plastic foam, are buoyant and are frictionally engaged with a wall 12 of the pool 11.

The pads 16 are connected to support arms 20 which extend to opposite ends of structural tubes 21 and 22, which are engaged in side panels 24 and 25 and center panel 26. The panels 24, 25 and 26 are of semi-rectangular configuration, with an additional structural tube 27 engaged therewith spaced forwardly from tube 21, as shown in FIG. 3.

The panels 24, 25 and 26 make up a housing 30 which includes two slide tubes 31 and 32, with arms 33 and 34 extending therefrom, pivotedly engaged with a shaft 35 also engaged with the panels 24, 25 and 26.

The tubes 31 and 32 are hollow and carry travel rods 40 and 41 which have anti-torque tubes 42 and 43 secured on the lower ends thereof.

The tubes 42 and 43 are hollow, and have elastic cords 45 and 46 slidably engaged therewith, which cords are fastened at their ends to the structural tubes 21 and 27. It should be noted that the travel rods 40 and 41 are frictionally engaged in the slide tubes 31 and 32 and capable of limited movement vertically as shown in FIGS. 3 and 4.

The travel rods 40 and 41 have offset portions 47, 48, 49 and 50 with shoulder pads 55 and 56, pivotedly engaged therewith and which can pivot through an angle of 90 degrees, and can move in a front to back direction an angle of 45 degrees. The shoulder pads 55 and 56 are of circular configuration, can be constructed of foamed synthetic plastic, and are intended to engage the shoulders of a swimmer (not shown).

In the preferred embodiment, the shoulder pads 55 and 56 are separated a distance of 9 inches which has been found suitable to accommodate a large range of sizes of swimmers.

The mode of operation will now be pointed out.

The apparatus 10 is placed in a pool 11 with the housing 30 placed near the bottom of the pool (not shown) and the pads 16 engaged with a wall 14, and due to their buoyancy support the apparatus 10. The swimmer (not shown) moves into position and engages the pads 55 and 56 with his shoulders (not shown).

The swimmer can then practice his normal swimming movements, most particularly that of the four (4) basic strokes: freestyle, backstroke, breaststroke, and butterfly.

The forward movement of the swimmer (not shown) moves the pads 55 and 56 and the travel rods 40 and 41, respectively, forward and backward against the elastic cords 45 and 46, simulating the resistance a swimmer meets in swimming through the water and providing the resistance at the most ideal locations, i.e., the swimmer's shoulders. It should be noted the pads 55 and 56 rotate with the twisting movement of the swimmer's body, and that the travel rods 40 and 41 can be moved vertically to accommodate different desired height requirements.

It will thus be seen that structure has been provided with which the objects of the invention are attained.

I claim:

1. Apparatus to be used in a swimming pool for improving a swimmer's proficiency comprising:

(a) housing means adapted to be placed on the bottom of a pool, (b) a pair of wall engaging support arms extending from said housing means and each including a buoyant friction pad for engagement with the pool wall, (c) swimmer engagement means comprising a pair of shoulder pads each attached to a travel rod pivotally connected to said housing means, said housing means including resistance means for providing rotational resistance to pivotal movement of said travel rods.

* * * * *